United States Patent [19]

Christians

[11] Patent Number: 4,901,371

[45] Date of Patent: Feb. 20, 1990

[54] INFANT BAG GARMENT

[76] Inventor: Bonnie S. Christians, P.O. Box 1025, Del Mar, Calif. 92014

[21] Appl. No.: 264,346

[22] Filed: Oct. 31, 1988

[51] Int. Cl.[4] ..... A41B 13/06

[52] U.S. Cl. ..... 2/69.5; 2/83; 2/80

[58] Field of Search ..... 2/69.5, 83, 111; 450/115, 116, 124, 131, 132

[56] References Cited

U.S. PATENT DOCUMENTS

| | | | |
|---|---|---|---|
| 2,234,546 | 3/1941 | Basch | 2/69.5 |
| 2,441,900 | 5/1948 | Oswald | 2/69.5 |
| 2,496,922 | 2/1950 | Virtue | 2/69.5 |
| 2,578,323 | 12/1951 | Sillaway | 2/69.5 |
| 2,663,873 | 12/1953 | Stern | 2/83 |
| 2,680,849 | 6/1954 | Munro | 2/69.5 |
| 2,723,398 | 11/1955 | Tuteur | 2/69.5 |
| 2,812,516 | 11/1957 | Hoffman | 2/80 |
| 2,849,718 | 9/1958 | Wheelock | 2/83 |
| 2,908,912 | 10/1959 | Darling | 2/83 |
| 2,966,912 | 1/1961 | Murdock | 450/116 |
| 3,080,869 | 3/1963 | Alberts | 450/132 X |
| 3,245,410 | 4/1966 | Martin | 450/132 X |
| 3,327,707 | 6/1967 | Storti | 450/115 |
| 4,125,910 | 11/1978 | Nicholai | 2/69.5 |
| 4,421,117 | 12/1983 | Klausen et al. | 450/131 |
| 4,538,615 | 9/1985 | Pundyk | 450/131 |

FOREIGN PATENT DOCUMENTS

| | | | |
|---|---|---|---|
| 818153 | 7/1969 | Canada | 2/69.5 |

*Primary Examiner*—Werner H. Schroeder
*Assistant Examiner*—Jeanette E. Chapman
*Attorney, Agent, or Firm*—Brown, Martin, Haller & McClain

[57] ABSTRACT

A baby bag garment is provided which comprises a tubular body portion having a front and rear body panel which is longer at its sides than at its central portion with an elastic insert panel secured to the lower ends of the front and rear panels to substantially enclose the bottom of the garment. The garment can be worn by an infant secured in an infant carrier by a three or multi-point harness safety restraint having a center strap, such that the child's legs and feet can hang comfortably on opposite sides of the center strap.

8 Claims, 1 Drawing Sheet

INFANT BAG GARMENT

FIELD OF INVENTION

This invention relates to children's garments. More particularly, this invention relates to a baby bag garment so designed to permit its use in baby seats having a three point security harness system.

BACKGROUND OF THE INVENTION

Baby bag garments are well-known for providing comfort and warmth for infant children. Baby bags or sacks, as they are sometimes referred to, are convenient when caring for infant children because they eliminate the need for manipulating the feet of the infant into separate leg portions, for example, as in baby coveralls. However, existing baby bag designs are not suitable for the infant when it is being placed in a child carrier such as baby car seat, baby swing, front carriers, stroller or carriage. Most baby carriers now have the common "three point" harness design for child restraint or safety which is characterized by two shoulder straps and/or a waist strap for securing the child's shoulders and the upper body or waist, respectively, together with a center or crotch strap which extends from the lower portion of the carrier between the two legs of the child to his mid-body. Interference arises when one attempts to secure the straps at the mid-body area of the infant because the baby bag does not yield to the center strap which must be extended from the lower portion of the carrier and between the legs of the baby for engagement. The result is that the traditional baby bag will not allow the child's legs to hang comfortably on opposite sides of the center strap when it is engaged properly.

One baby bag design provides a full width access opening at its bottom for exposing the lower portion of the baby's body so as to facilitate care of the baby, as in changing diapers. In another design, two openings are provided at the corners of the lower portion of the baby bag to permit the feet of the baby to extend outside the bag. These two types of baby bag garment designs are not suitable for wear by the baby when placed in the child carrier because extension of the center strap will be difficult due to the presence of the bag material between the child's legs. Of course, for baby bags having bottom openings, the lower portion of the bag may be pulled up to the waist area so as to permit the extension of the center strap between the legs of the child to the buckle. However, this exposes the child's feet outside the comfort and warmth of the baby bag, and it is awkward. The lack of a suitable design to allow the legs and feet of the baby to hang comfortably on opposite sides of the center strap forces a parent to transfer the infant into another type of garment, which is both annoying to the child (particularly when the child is asleep) and inconvenient to the parent.

Accordingly, what is needed is a baby bag which allows the child to be comfortably secured in a baby carrier using a three point harness system. Such a baby bag design should accommodate the center strap and at the same time allow the child's legs and feet to hang comfortably on opposite sides of the center strap.

SUMMARY OF THE INVENTION

This invention provides a bag-like garment for an infant which incorporates a tubular body portion having front and rear body panels. Both front and rear body panels are longer at the sides than at the central portions along the medial plane of the garment. An elastic insert panel is secured to the lower edges of the front and back panels to substantially enclose the lower end of the garment.

The elasticity of the insert panel material is preferably such that when subject to a force of two pounds, its length can be stretched by at least 50 percent. The insert panel is preferably of one-piece construction extending from the front to the back panels to enclose the bottom of the garment. The insert panel is commonly cut to present a generally triangular appearance in front and rear, although it may also be cut to appear as a different shape, such as semicircular, rectangular or trapezoidal. The garment described in this invention can therefore be worn by an infant secured in an infant carrier by a three point harness safety restraint such that the child's legs and feet can hang comfortably on opposite sides of the center strap.

DETAILED DESCRIPTION AND PREFERRED EMBODIMENTS

Figure 1:
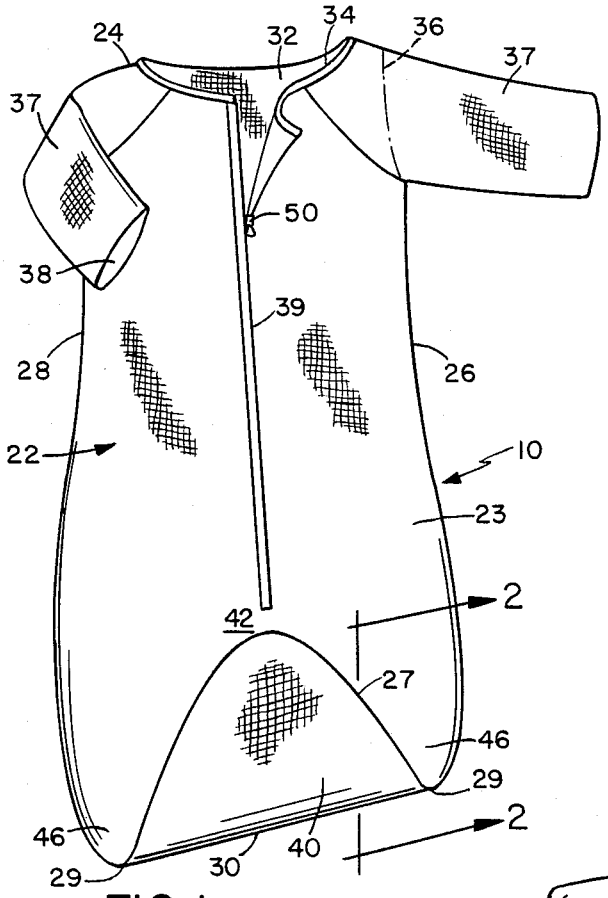
FIG. 1 is a perspective view of the baby garment of this invention with the elastic panel.
Figure 3:
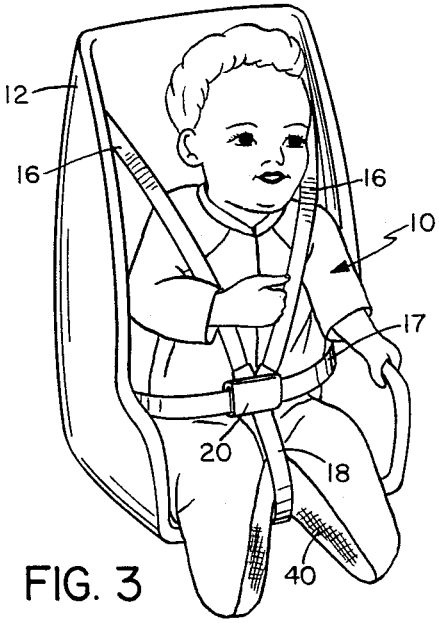
FIG. 3 illustrates the garment being worn by an infant in a car seat.

FIG. 1 shows a baby bag garment 10 according to the present invention. In FIG. 3, the baby bag garment 10 is shown being worn by a child secured within a typical baby carrier 12. The baby carrier includes a multi-point harness strapping system consisting of two shoulder straps 16, waist strap 17 and a center strap 18 engaged by a buckle 20 located at the waist or mid-body area of the child. In the following discussions, references are made to the three point harness system which is characterized by two shoulder straps 16 and a center strap 18. In other designs, the waist straps 17 are used in lieu of, or in addition to, the shoulder straps 16. The three point harness system is typically found in many child carriers such as baby car seats, swing seats, strollers and carriages. The baby bag garment 10, according to the present invention, allows the two legs and feet of the child to hang comfortably on opposite sides of center strap 18 where it is used regardless of whether the shoulder and/or the waist harness is used.

In the preferred embodiment of the present invention, the baby bag garment 10 consists of a tubular body member 22 of sufficient length to extend from the child's shoulders to beyond its feet. The body 22 is normally formed of a front panel 23 and a rear panel 25 which are joined together at the top 24, sides 26 and 28 and the bottom 29. The panels 23 and 25 are not joined, however, along their respective inwardly extending lower edges 27 and 31. At the upper portion of the body 22 a neck opening 32 is provided through which the neck and the head of the child projects. In the front panel 23 there is a slit or vent 39 arranged centrally which extends downwardly from the neck opening 32 to mid- to low-body area of the front panel 23. Slit 39 is closeable, preferably by a slide fastener 50 such as a zipper. In one embodiment, an aperture 36 (as shown in phantom lines) is provided at the upper corners of body 22 to allow the arms and hands of the child to project outside body 22. In another embodiment, sleeves 37 are attached to the body 22 and extend outwardly from aperture 36 for covering the arms of the child. Opening 38 is provided at the end of each sleeve 37 so that the hand of the child can project beyond. Other than these openings, the baby ba is essentially closed at its top 24, sides 26 and 28, and bottom 29. With the exception of the insert portion 40 as discussed below, the material used for the construction of the body portion can be any fabric which is commonly used for baby garments.

Figure 2:
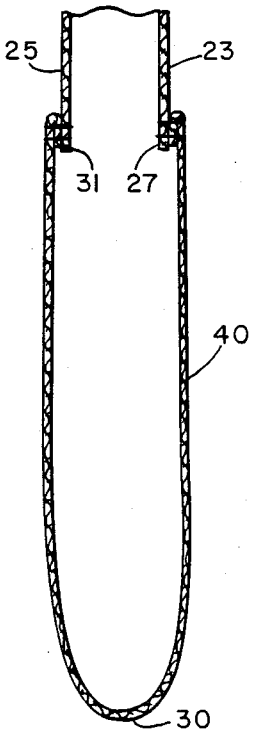
FIG. 2 is an enlarged sectional view taken on line 2—2 of FIG. 1.
Figure 4:
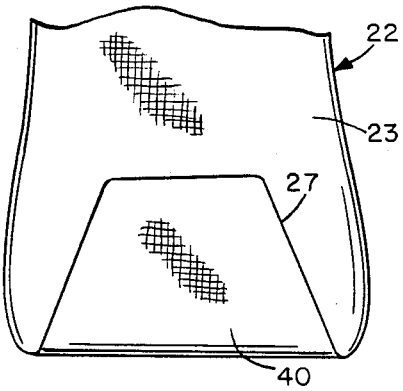
FIG. 4 illustrates an alternative elastic panel configuration.

The body member 22 has a bottom which is elongated downwardly on either side of the medial plane of body 22. The elongated bottom portions 46 generally cover the feet and legs of the child. According to the present invention, an insert panel or insert 40 is provided and is secured to both the front panel 23 and the rear panel 25 of the body 22 along the edges 27 and 31, meeting at bottom 29, to close the lower end of bag 10 as shown in FIGS. 1 and 2. The area covered by the insert 40 generally represents the lower portion of the baby bag between the two legs of the infant child. In one embodiment of the invention, insert 40 on both the front and rear panels 23 and 25 is defined by an area that starts from a point generally located at the mid- to low-body area 42 of the child and extends downwardly to the two opposite lower corners 46 of the baby bag, as shown in FIG. 1. In the preferred embodiment of the invention, the insert 40, as it appears in its front aspect, is generally triangular in shape. Other shapes, such as semicircular, rectangular or trapezoidal (shown in FIG. 4) can also be used.

Insert 40 is secured to the front and rear panels 23 and 25 of body 22, preferably by stitching. In the preferred embodiment, insert 40 extends from the mid-body area 42 along the front panel 23 from edge 27 toward the bottom of body portion 22 and around its lower end from the front to rear and continues upward to join back panel 25 along edge 31, to close the bottom of the baby bag 10 as seen in FIG. 2. The material used for insert 40 is elastic in order to allow the fabric to be stretched by as much as 50 percent in any direction when subject to a force of two pounds, and preferably 75 percent with a force of five pounds. The elastic property of the fabric for insert 40 is preferably non-directional, that is, without regard to the orientation of the fabric. However, it is also possible to use materials having defined elastic orientation. In such case, the orientation of the elasticity should be in a direction transverse to the medial plane of the baby bag. Insert 40 is preferably of one-piece construction extending from the front to the back of the baby bag 10 so as to realize the maximum elasticity in the fabric material when the center strap 18 is engaged between the legs and feet of the child.

The garment of this invention is used in the following manner. The child is placed in the garment through the neck opening 34 and slit portion 39 in the front of the garment. The child's arms are then negotiated through apertures 36, and, if present, the sleeve portions 37, so that the child's hands can extend beyond the sleeve openings 38. Opening 39 is then secured by closing the zipper 50 or other fastening means. It will then be seen that the garment thus completely covers the child except for his head and hands and perhaps arms.

When it is desired to place the child in a child carrier, such as a car seat or an infant swing which contains a three or multipoint harness system for child restraint, there is no need to change the child's garment to a style containing separate feet and leg portions. The child can simply be positioned in the carrier 12, followed by the engagement of the two shoulder straps 16 which extend from the upper back portion of the carrier (and/or waist strap 17) with buckle 20. In many designs of the child restraint harness system, buckle 20 is made part of the center strap 18 which is secured to the bottom of the seat. In securing the straps of the carrier, the center strap 18 is pulled in a forward direction to engage the bottom of the baby bag body portion 22 between the legs and feet of the child and toward the child's waist area. Because of the elasticity in the material, insert 40 will be stretched inwardly in response to the force of the center strap 18 such that the two legs and feet of the child can hang freely and comfortably on the opposite sides of the center strap 18.

This invention thus provides a infant bag garment which completely covers the child's legs, feet and body, while at the same time permitting the child to be placed under the restraint of a three point harness safety system typical of many baby carriers. It will be seen that this invention is simple and inexpensive in its construction and provides convenience and efficiency in its use.

It will be recognized that there are numerous other embodiments of this invention which, while not illustrated above, are clearly within the scope and spirit of the invention. The above description is therefore to be considered exemplary only, and the scope of the invention is to be limited solely by the appended claims.

What is claimed is:

1. A garment for a child comprising:

a substantially tubular member to enclose the child's torso and lower extremities and having a front, a back, lateral sides with a medial plane intermediate therebetween, an upper end at least partially open and a bottom edge, said bottom edge being closer to said upper end at said medial plane of said garment and extending downwardly and outwardly toward said lateral sides of said garment, to define elongated lower ends on said opposite lateral sides, a line extending between said elongated lower ends defining the bottom of said garment; and elastic panel means joined to said tubular member along the entire length of said bottom edge and substantially completely closing said tubular member at said bottom end, said panel means being a unitary elastic piece of fabric beginning at the front of said garment and extending outwardly of either side of the medial plane of said garment and downwardly toward said opposite lower end of said garment, around the bottom of said garment an upwardly and inwardly to a corresponding point on the back of said garment, such that said panel means can be distended upwardly to accommodate placement of a strap between the legs and feet of said child.

2. The garment according to claim 1 wherein the elasticity of said elastic panel is such that the panel can be stretched by at least 50 percent in material length when subject to a force of two pounds.

3. The baby garment according to claim 1 wherein said elastic panel for said front and rear panels is of unitary construction.

4. The baby garment according to claim 1 wherein the elastic panel has non-directional elasticity.

5. The baby garment according to claim 1 wherein the elastic panel has an elastic property oriented in a direction transverse to the medial plane of said garment.

6. The baby garment according to claim 1 wherein said insert panel is substantially triangular in front aspect.

7. The baby garment according to claim 1 wherein said insert panel is substantially trapezoidal in front aspect.

8. The baby garment according to claim 1 wherein said body portion comprising an aperture located on either sides of the upper portion of said garment, a sleeve secured to said aperture to adaptably permit the hand of a child to project therebeyond, a top middle opening for the head of the child to adaptably project, and a slit extending from said top middle opening to the mid body portion of said garment, said slit being releasably secured.

* * * * *